United States Patent [19]

Hergeth

[11] Patent Number: 4,520,531

[45] Date of Patent: Jun. 4, 1985

[54] APPARATUS FOR MAKING A WEB FROM FIBERS

[76] Inventor: Hubert Hergeth, Kockerellstr. 3, Aachen, Fed. Rep. of Germany

[21] Appl. No.: 606,349

[22] Filed: May 2, 1984

[30] Foreign Application Priority Data

May 2, 1983 [DE] Fed. Rep. of Germany ..... 3315909
Aug. 5, 1983 [DE] Fed. Rep. of Germany ..... 3328358

[51] Int. Cl.[3] ..... D01G 15/40

[52] U.S. Cl. ..... 19/105; 19/145.7; 19/240; 19/300

[58] Field of Search ..... 19/105, 300, 301, 240, 19/145.7, 296

[56] References Cited

U.S. PATENT DOCUMENTS

| | | | |
|---|---|---|---|
| 3,973,291 | 8/1976 | Kolbach | 19/301 X |
| 4,161,052 | 7/1979 | Erben | 19/105 X |
| 4,271,565 | 6/1981 | Grunder | 19/240 |
| 4,280,251 | 7/1981 | Ludwig | 19/105 |
| 4,394,790 | 7/1983 | Keller et al. | 19/105 |
| 4,404,710 | 9/1983 | Wood | 19/105 |
| 4,414,710 | 11/1983 | Bolen | 19/105 |

*Primary Examiner*—Louis K. Rimrodt

*Attorney, Agent, or Firm*—Karl F. Ross; Herbert Dubno

[57] ABSTRACT

An apparatus for making a web of fibers has an upright and horizontally elongated supply duct having an upper end, an open lower end, and a foraminous side wall. Fibers are fed to the upper end of the supply duct so that they descend in this duct as a ribbon-shaped web. An upright and horizontally elongated forming duct has an upper end receiving the fiber web from the supply duct, a lower end, and a foraminous side wall. Gas is made to flow down in the ducts and through the foraminous side walls thereof to shape the web and advance it to the respective lower ends. Rollers are provided at the lower end of the forming duct for withdrawing the web therefrom. One or more sensors measure the thickness of the web at a plurality of sensing locations spaced transversely along the web downstream of the lower end of the forming duct. Respective individually operable flow-adjusting means can vary the gas flow in one of the ducts at respective zones spaced transversely across the web like the sensing locations. A controller is connected between the detecting and adjusting units for varying the flow in accordance with the detected thickness.

14 Claims, 6 Drawing Figures

APPARATUS FOR MAKING A WEB FROM FIBERS

FIELD OF THE INVENTION

The present invention relates to the manufacture of a nonwoven web from fibers. More particularly this invention concerns a method of and apparatus for producing a coherent web or mat of ordered fibers from a mass of disordered fibers.

BACKGROUND OF THE INVENTION

A mat such as is cut up and spun into yarn or of the type used in filters or diapers, or as insulation, is typically made from lint-like fibers. These fibers are delivered at random to the upper end of an upright and horizontally elongate supply duct in which they are distributed and fall as a ribbon-shaped web. At the lower end of this duct the the web passes out, normally between two feed rollers, into the upper end of a forming duct that is also horizontally elongated and that extends parallel to the supply duct.

Baffles are normally provided in the supply duct to distribute the fibers uniformly therein over the entire width of the duct, the width being measured perpendicular to the longitudinal direction of the web across its greatest transverse dimension. This is done to make the thickness of the web uniform, the thickness being measured transversely both to the width and to the longitudinal direction across the workpiece.

Such an arrangement often is inadequate to compensate for a partial blockage of the feeding device, or other anomalies that might affect workpiece thickness. Even if the baffles are adjusted and rearranged to compensate for some workpiece fault, it is fairly common for a new problem to develop which creates a longitudinal groove or ridge in the workpiece.

OBJECTS OF THE INVENTION

It is therefore an object of the present invention to provide an improved method of and apparatus for making a web from fibers.

Another object is the provision of such a method of and apparatus for making a web from fibers which overcomes the above-given disadvantages, that is which produces a web or mat of uniform thickness even under changing working circumstances.

SUMMARY OF THE INVENTION

An apparatus for making a web of fibers according to the invention has an upright and horizontally elongated supply duct having an upper end, an open lower end, and a foraminous side wall. Fibers are fed to the upper end of the supply duct so that they descend in this duct as a ribbon-shaped web. An upright and horizontally elongated forming duct has an upper end receiving the fiber web from the supply duct, a lower end, and a foraminous side wall. Gas is made to fflow down in the ducts and through the foraminous side walls thereof to shape the web and advance it to the respective lower ends. Rollers are provided at the lower end of the forming duct for withdrawing the web therefrom. One or more sensors measure the thickness of the web at a plurality of sensing locations spaced transversely along the web downstream of the lower end of the forming duct. Respective individually operable flow-adjusting means can vary the gas flow in one of the ducts at respective zones spaced transversely across the web like the sensing locations. A controller is connected between the detecting and adjusting means for varying the flow in accordance with the detected thickness.

With this system it is therefore possible to achieve automatic and unsupervised adjustment of the web to changing circumstances. If one of the ducts becomes temporarily partially blocked, flow will be adjusted to compensate for the thin spot this would create, and in fact the adjustment often will clear the blockage. Small variations in thickness can even be compensated for relatively easily, making the resultant product perfectly uniform.

The flow adjustment is executed according to a feature of this invention in the forming duct. More particularly the foraminous side wall of the one duct has a transversely extending foraminous window and the forming elements are nonforaminous slides displaceable between positions covering respective portions of the window and positions leaving same clear. The controller includes respective linear actuators for displacing the slides between their respective positions.

The detecting system of this invention can include a plurality of sensors spaced transversely across and effective on the web downstream of the lower end of the forming duct. It is also possible to use a single sensor displaceable transversely across the web through a plurality of individual sensing stations downstream of the lower end of the forming duct. It is even within the scope of this invention to detect web thickness at the lower end of the supply duct by appropriate flaps engageable with the web there.

Typically the detecting means is provided relatively far from the lower end of the forming duct, although it is of course possible for it to be provided immediately adjacent the lower end of the forming duct. When the apparatus also has a carding unit downstream of the lower end of the forming duct for the web issuing therefrom, the detecting unit is downstream of the carding means.

It is also within the scope of this invention for the one duct to have a side wall provided with a plurality of blocking elements displaceable into and out of the duct and constituting the flow-adjusting elements. These blocking elements are shiftable perpendicular to the web between positions projecting into the one duct and positions relatively clear of the one duct. In addition they can be at least partially inflatable and the controller can have means for inflating the blocking elements and thereby projecting same into the one duct.

In another arrangement according to the invention the upper end of the forming duct is provided with a full-width slot and means is provided for blowing a full-width stream of air down into the forming duct from the slot. In this case the elements are associated with the slot and displaceable to vary flow therefrom.

DESCRIPTION OF THE DRAWING

The above and other features and advantaes will become more readily apparent from the following, it being understood that any feature described with reference to only one embodiment of the invention can be used where possible with any other embodiment. In the accompanying drawing.

SPECIFIC DESCRIPTION

Figure 1:
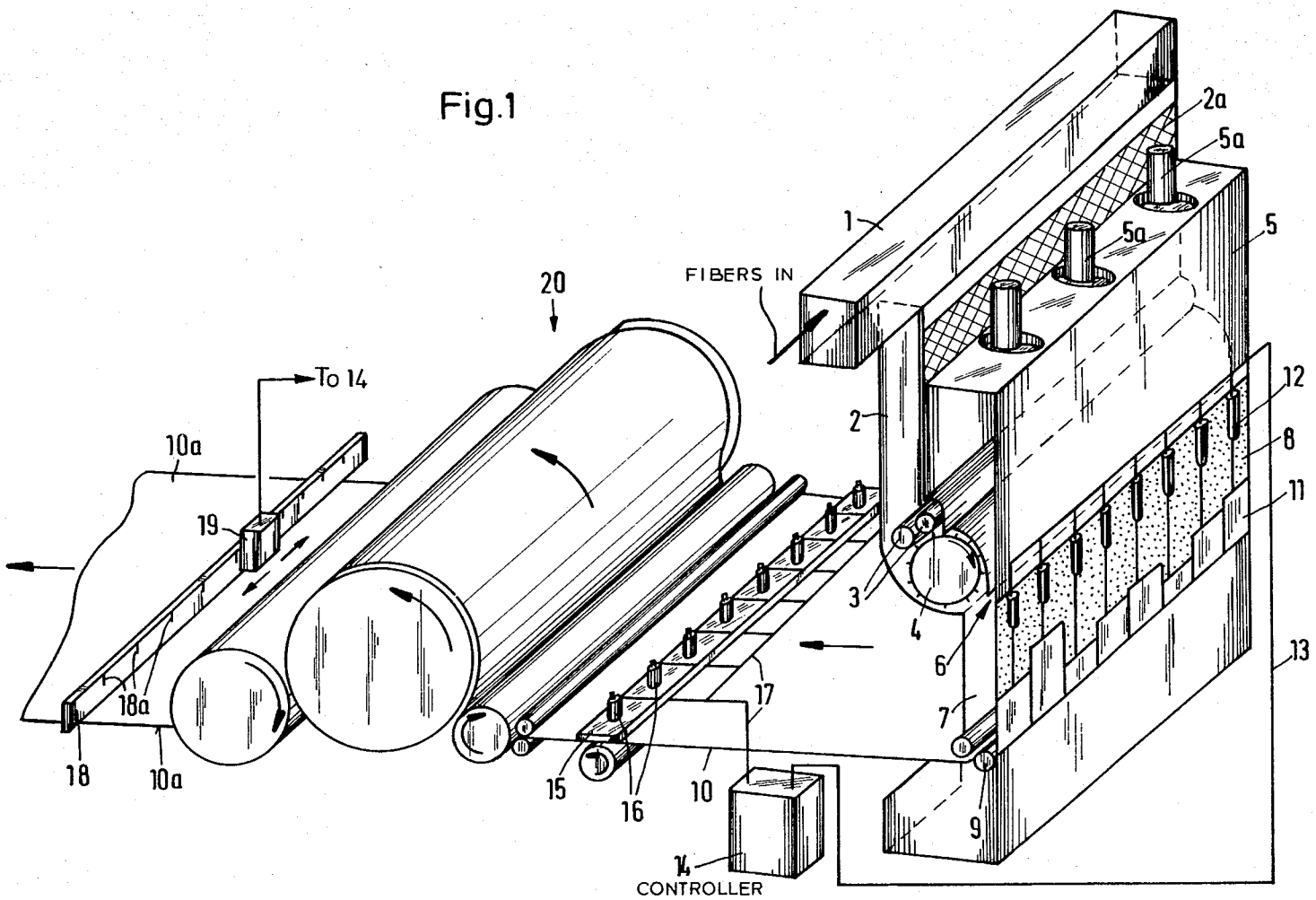
FIG. 1 is a partly schematic perspective view of an apparatus according to this invention.
Figure 2:
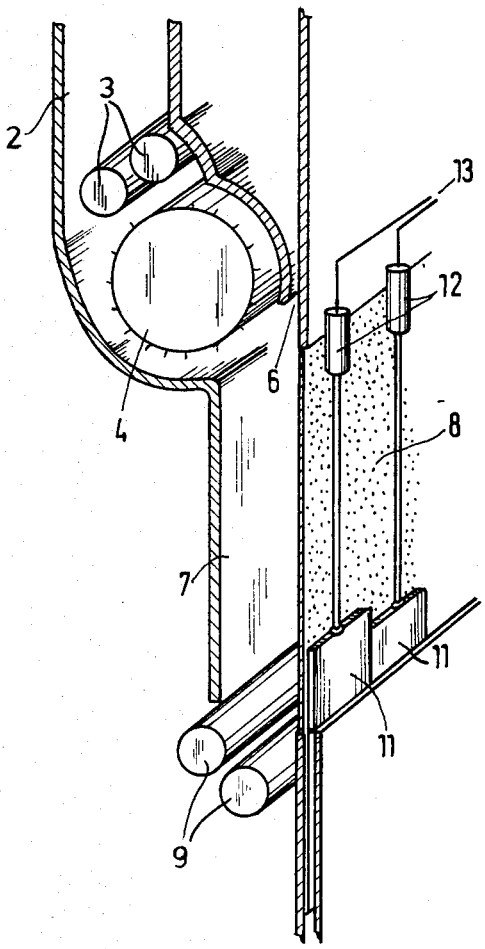
FIG. 2 is a large-scale view of a detail of FIG. 1.

As seen in FIGS. 1 and 2, a feed conduit 1 supplies fibers to the upper end of an upwardly open and horizontally elongated supply duct 2 at whose lower end is provided a pair of small-diameter feed rollers 3 followed by a large-diameter pin-type feed roller 4. The rollers 3 and 4 order and empty the fibers into the upper end of a similar rectangular-section and horizontally elongated duct 7 having a downwardly directed nozzle opening 6 extending its full length at its upper end, and a front wall 8 that is foraminous, here perforated, so gas can travel readily through it. A horizontally elongated plenum chamber 5 is connected at its top to air-supply pipes 5*a* for air under pressure and opens at the slot or opening 6 to form a downwardly directed and horizontally elongated stream of air blowing past the lower outlet end of the duct 2 and entraining the fibers issuing therefrom down in the duct 7. The bottom end of this duct 7 in turn is provided with two more feed rollers 9 from which comes a felted web 10 that is passed as is known over a carding roll 20. This product is a loose nonwoven batting 10*a* that can be used directly as insulation, diaper filling, filter material, or the like, or that can be cut up for spinning and twisting into filaments.

According to this invention a controller 14 of the microcomputer type is used to detect the thickness of the web 10 downstream of the rollers 9. This can be done in two ways according to FIG. 1. A rail 15 can support eight thickness sensors 16 equispaced transversely across the web 10 downstream of the rollers 9 at spacings of 10 cm to 20 cm. These sensors are connected via input lines 17 to the controller 14. In addition it is possible to provide a single sensor 19 movable on a transversely extending beam 19 through eight measuring stations 18*a* immediately downstream of the carding unit 20. The number of measurements can be greater or less than the eight shown, of course.

The foraminous wall 8 of the duct 7 is also subdivided transversely into eight zones, each of which has a respective slider or shutter 11 operated by a respective solenoid actuator 12 connected via a line 13 to the controller 14. These actuators 12 can therefore position the shutters 11 to completely block off outflow of air at the respective zones of the wall 8 or to open them up to a certain maximum corresponding to no covering of the respective zones at all. When one of the zones of the wall 8 is covered up, the air flow down in the duct 7 immediately adjacent the covered zone is correspondingly limited and vice versa.

Figure 4:
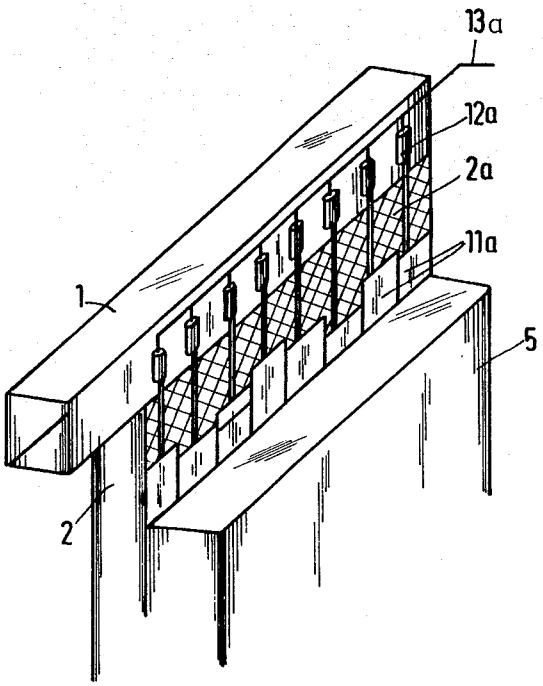
FIG. 4 is a detail view of a variation on the system of FIG. 1.

As shown in FIG. 4 the front wall 2*a* of the supply duct 2 is also foraminous, and can be provided with shutter/sliders 11*a* controlled by actuators 12*a* connected via a line 13*a* to the controller 14. These shutters 11*a* are individually controllable to vary the flow in the duct 2.

Whether the sensor 10 or the sensors 16 are used at the input or the actuators 12 or 12*a* at the output, the controller 14 compares the actual-value thickness signals for the eight zones of the web with set point signals, or simply with an average of all eight signals, and displaces the respective control element constituted by a slider 11 or 11*a* to effect the necessary increase or decrease in thickness.

Figure 3:
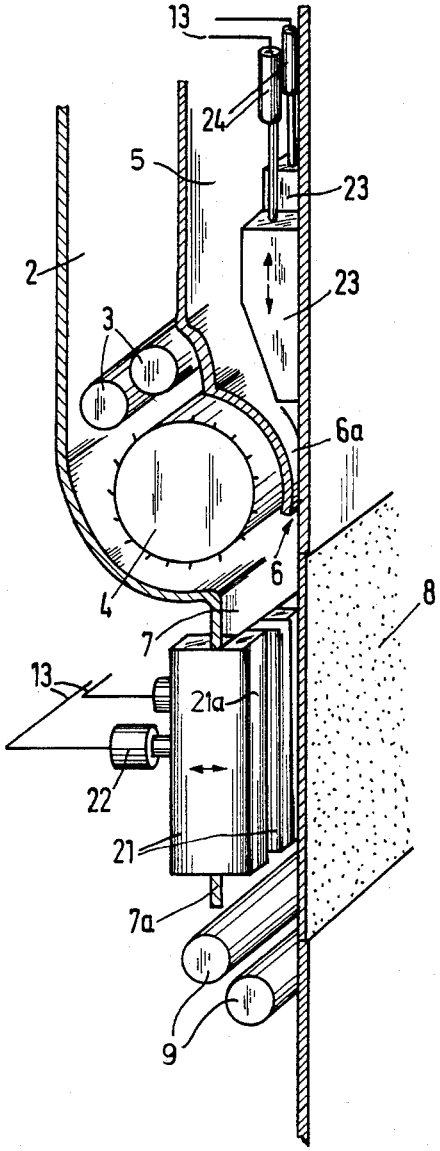
FIG. 3 is a view like FIG. 2 of a detail of another apparatus according to this invention.

FIG. 3 shows another arrangement wherein flow-blocking elements 21 can be provided in the back wall 7*a* of the duct 7, movable toward and away from the front wall 8 in a horizontal direction transverse to the longitudinal direction of elongation of the duct 7. Respective actuators 22 are connected to these blocks 21 which correspond to the zones of the sensors 16 so that they can move them in and out, variously restricting the flow cross section of the respective zone of the duct 7. The front faces 21*a* of these blocks 21 can be of an elastomer, and the actuators 22 can be pneumatic so that in addition to or instead of moving the entire blocks 21, these faces 21*a* can be inflated from behind to bulge into the duct 7, thereby limiting flow. The flow relationships in this arrangement can be reversed by providing the blocking elements 21 in the foraminous side of the duct 7.

In addition the plenum 5 of FIG. 3 is provided above the slot 6 with a plurality of flow-blocking elements or wedges 23 displaceable by respective actuators 24 to adjust the incoming air at zones corresponding to the sensors 16 or sensor stations 18*a*. It would also be possible to form the wall of the plenum 5 at the slot 6 of a row of adjacent tongue-like flaps that could be individually controlled in accordance with the thickness detected downstream to vary the air flow at this region.

Figure 5:
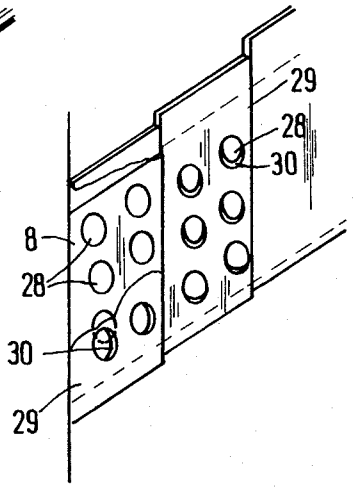
FIG. 5 is a large-scale view of a detail of yet another apparatus according to the invention.

In FIG. 5 the wall is shown in more detail, with the holes 28 that make it foraminous. Here sliders 29 are provided formed with identical holes 30 that can either be perfectly aligned with the holes 28 for maximum flow or can be offset therefrom to limit or stop flow through the respective zone. The advantage of such slides 29, which can replace the slides 11 or 11*a*, is that in a very short stroke equal to the hole diameter it is possible to move from the fully open to the fully closed position.

Figure 6:
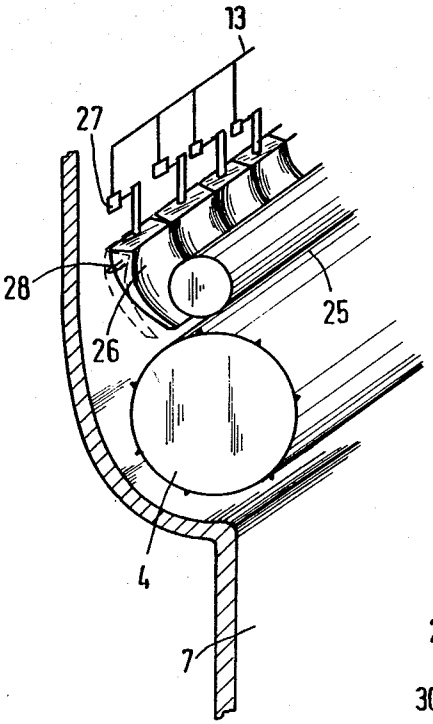
FIG. 6 is a partly sectional and schematic view of a detail of yet another system in accordance with the present invention.

The FIG. 6 arrangement has, instead of the rollers 3, a roller 25 cooperating with a plurality of gap-defining sensor elements 26 defining respective sensor zones. These elements 26 are shaped as tongues and are pivotal about an axis 29 parallel to the elongation direction of the slot 2 and are connected to respective position detectors 27 to detect the thickness of the flow of fibers down out of the supply chute or duct 2.

With the system of this invention it is therefore possible to produce a product of very uniform thickness. Even momentary problems in the production process, such as a temporary wadding up of the fibers somewhere in the system, will be compensated for and normally cleared automatically.

I claim:

1. An apparatus for making a web of fibers, the apparatus comprising:

an upright and horizontally elongated supply duct having an upper end, an open lower end, and a foraminous side wall;

means for feeding fibers to the upper end of the supply duct, whereby the fibers descend in this duct as a ribbon-shaped web;

an upright and horizontally elongated forming duct having an upper end receiving the fiber web from the supply duct, a lower end, and a foraminous side wall;

means for flowing gas down in the ducts and through the foraminous side walls thereof for shaping the web and advancing it to the respective lower ends;

means at the lower end of the forming duct for withdrawing the web therefrom;

means for measuring the thickness of the web at a plurality of sensing locations spaced transversely along the web downstream of the lower end of the forming duct;

respective individually operable flow-adjusting means for varying the gas flow in one of the ducts at respective zones spaced transversely across the web like the sensing locations; and control means connected between the detecting and adjusting means for varying the flow in accordance with the detected thickness.

2. The apparatus defined in claim 1 wherein the flow-adjusting means are provided on the forming duct.

3. The apparatus defined in claim 1 wherein the foraminous side wall of the one duct has a transversely extending foraminous window, the forming elements being nonforaminous slides displaceable between positions covering respective portions of the window and positions leaving same clear, the control means including respective linear actuators for displacing the slides between their respective positions.

4. The apparatus defined in claim 1 wherein the detecting means includes a plurality of sensors spaced transversely across and engageable with the web downstream of the lower end of the forming duct.

5. The apparatus defined in claim 1 wherein the detecting means includes a single sensor displaceable transversely across the web through a plurality of individual sensing stations downstream of the lower end of the forming duct.

6. The apparatus defined in claim 1 wherein the detecting means is provided relatively far from the lower end of the forming duct.

7. The apparatus defined in claim 1 wherein the detecting means is provided immediately adjacent the lower end of the forming duct.

8. The apparatus defined in claim 1, further comprising means downstream of the lower end of the forming duct for carding the web issuing therefrom, the detecting means being downstream from the carding means.

9. The apparatus defined in claim 1 wherein the one duct has a side wall provided with a plurality of blocking elements displaceable into and out of the duct and constituting the flow-adjusting elements.

10. The apparatus defined in claim 9 wherein the blocking elements are shiftable perpendicular to the web between positions projecting into the one duct and positions relatively clear of the one duct.

11. The apparatus defined in claim 10 wherein the blocking elements are at least partially inflatable and the control means includes means for inflating the blocking elements and thereby projecting same into the one duct.

12. The apparatus defined in claim 1 wherein the upper end of the forming duct is provided with a full-width slot, the apparatus further comprising means for blowing a full-width stream of air down into the forming duct from the slot, the control flow elements being associated with the slot and displaceable to vary flow therefrom.

13. The apparatus defined in claim 1, further comprising sensor means connected to the control means for detecting web thickness at a plurality of transversely spaced locations in the supply duct.

14. A method of making a web of fibers with the apparatus comprising:

an upright and horizontally elongated supply duct having an upper end, an open lower end, and a foraminous side wall; and an upright and horizontally elongated forming duct having an upper end receiving the fiber web from the supply duct, a lower end, and a foraminous side wall; the method comprising the steps of:

feeding fibers to the upper end of the supply duct so that the fibers descend in this duct as a ribbon-shaped web;

flowing gas down in the ducts and through the foraminous side walls thereof to shape the web and advance it to the respective lower end;

withdrawing the web from the lower end of the forming duct for withdrawing the web;

measuring the thickness of the web at a plurality of sensing locations spaced transversely along the web downstream of the lower end of the forming duct; and individually varying the gas flow in one of the ducts at respective zones spaced transversely across the web like the sensing locations.

* * * * *